United States Patent [19]

Allen

[11] Patent Number: 4,550,456

[45] Date of Patent: Nov. 5, 1985

[54] INFANT CRADLE ASSEMBLY

[76] Inventor: James E. Allen, 126 E. Colfax, Palatine, Ill. 60067

[21] Appl. No.: 577,559

[22] Filed: Feb. 6, 1984

Related U.S. Application Data

[63] Continuation-in-part of Ser. No. 423,992, Sep. 27, 1982, abandoned.

[51] Int. Cl.[4] ..... A47C 29/00; A47D 7/00

[52] U.S. Cl. ..... 5/98 B; 5/99 B; 5/99 C; 5/102; 5/107

[58] Field of Search ..... 5/94, 98 B, 98 C, 99 A, 5/99 B, 101, 102, 104, 105, 107, 120, 122, 123, 127, 130; 24/136 R; 135/90, 120

[56] References Cited

U.S. PATENT DOCUMENTS

| | | | |
|---|---|---|---|
| 279,665 | 6/1883 | Reed | 5/102 |
| 483,218 | 9/1892 | Hayden | 5/98 B |
| 595,235 | 12/1897 | Amrock | 5/101 |
| 756,230 | 4/1904 | Goddard | 5/127 |
| 1,198,130 | 9/1916 | Hutchings | 5/101 |
| 1,478,768 | 12/1923 | Schwartz | 5/127 |
| 1,559,303 | 10/1925 | Bates | 5/104 |
| 2,688,997 | 9/1954 | Miller | 5/105 |
| 3,158,877 | 12/1964 | Cooper | 5/105 |
| 3,766,610 | 10/1973 | Thorsbakken | 24/136 R |
| 3,952,377 | 4/1976 | Morell | 24/136 R |

FOREIGN PATENT DOCUMENTS

| | | | |
|---|---|---|---|
| 843416 | 8/1960 | United Kingdom | 5/105 |

*Primary Examiner*—Gary L. Smith
*Assistant Examiner*—Michael F. Trettel
*Attorney, Agent, or Firm*—Edward D. Gilhooly

[57] ABSTRACT

An infant cradle assembly having a cloth sling sewn around the interconnecting tubes of a rectangular plastic frame. The frame is suspended by a plurality of elastic cords from a tubular fixture or sleeve capable of being attached to a strand, frame, and the like. The tubular fixture permits the length of the cords attached to one end of the frame to be adjusted relative to the other, so that the cradle may be tilted as desired in use. The cradle body is supported in a manner that it may undergo a multitude of motions while a baby is being rocked or swung.

10 Claims, 13 Drawing Figures

INFANT CRADLE ASSEMBLY

BACKGROUND OF THE INVENTION

This is a continuation-in-part of my copending application, Ser. No. 423,992, filed Sept. 27, 1982.

This invention relates in general to infant cradles and, in particular, to an infant cradle formed of a soft cloth sling attached to a frame.

More specifically, without restriction to the particular use which is shown and described, this invention relates to an infant cradle assembly having a cloth sling sewn about a lightweight, tubular frame. The cradle may be suspended by means of a plurality of elastic members that are carried on a novel support fixture, or in another embodiment, the cradle may be carried directed to a rocker frame. The support fixture is capable of being attached to any support structure and permits adjustability of the orientation of the cradle. The infant cradle assembly of the invention provides greater security and comfort for the child while being a device which is inexpensive to manufacture, lightweight and convenient to use.

Countless different designs for infant beds, hammocks and cradles have heretofore been introduced into the marketplace. It is a natural objective of articles of this type to receive an infant with security and comfort, while also desirably having the advantages of low cost, portability and convenience of use. In many instances, it is also a desirable objective to permit physical and visual stimulation of the baby while lying within the bed.

Prior art cradles suffer from numerous deficiencies by not being capable of offering one or more of the foregoing characteristics and generally provide a bed which can only be considered to be fair to poor in comfort, safety and versatility. Examples of prior art cradles or portable hammocks having such shortcomings are disclosed in U.S. Pat. No. 182,480 to Robertson; U.S. Pat. No. 562,321 to Ranney; U.S. Pat. No. 962,092 to Palmer; U.S. Pat. No. 1,113,429 to Christensen; and French Pat. No. 1,229,295.

SUMMARY OF THE INVENTION

It is, therefore, an object of this invention to provide an improved infant cradle assembly.

Another object of this invention is to provide a lightweight, inexpensive infant assembly being capable of carrying an infant with safety, security, and comfort while permitting physical stimulation.

A further object of this invention is to provide an infant cradle assembly capable of undergoing a multitude of complex motions during rocking or swinging to better stimulate and comfort the infant.

Still another object of this invention is to provide a cradle assembly suspended by a fixture which permits ready mounting, allows adjustment of the orientation of the cradle, and can function as a handle as a manual carrying unit.

Still another object of this invention is to improve the comfort and security of an infant within a hammock by providing a sling being mounted on an improved frame assembly.

A still further object of this invention is to provide a cradle assembly capable of convenient portability and washability of its fabric component.

Still another object of the invention is to provide a cradle capable of being mounted on a rocker frame.

These and other objects are attained in accordance with the present invention wherein there is provided an improved infant cradle assembly having a cloth sling sewn about a rectangular frame formed by a plurality of interconnected, tubular members. The cloth bottom of the cradle is uniquely comforting to the child and provides the baby with security of a close swaddled environment. The baby may be rocked, swung, or bounced in the cradle, which undergoes a multitude of complex motions due to the improved suspension of the cradle.

The elastic cords may be attached to a rocker frame, a stationery support stand, or other means. In a preferred embodiment, the elastic cords are carried by means of a sleeve through which a portion of the elastic cords extend. The support sleeve provides convenience and effective attachment of the cradle on whatever support means is desired. The sleeve also acts to provide for portability by acting as a potential handle and permits the cradle to be tilted with respect to the horizontal to allow visual observation of objects or people by an infant. The cradle of the invention is further capable of being folded flat for better handling and storage while not in use. In one embodiment, the cradle is carried by a rocker base which may be disassembled for ease of portability.

DESCRIPTION OF THE DRAWINGS

Further objects of the invention together with additional features contributing thereto and advantages accruing therefrom will be apparent from the following description of preferred embodiments of the invention which is shown in the accompanying drawings with like reference numerals indicating corresponding parts throughout, wherein.

DESCRIPTION OF THE PREFERRED EMBODIMENTS

Figure 1:
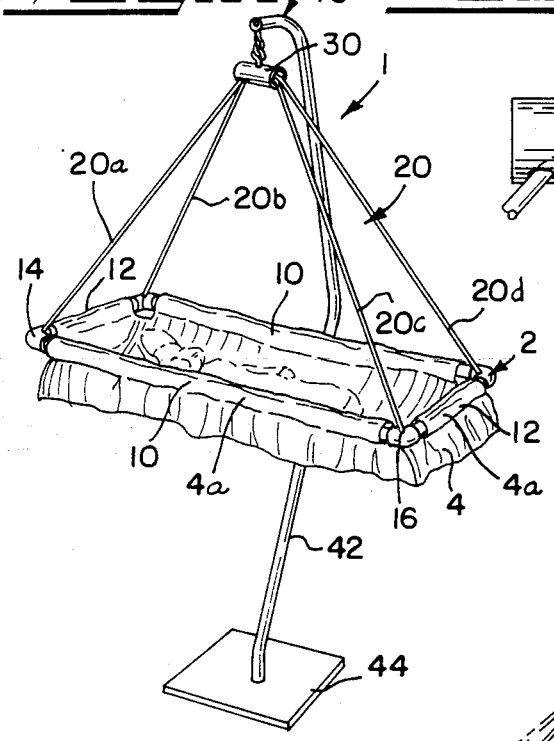
FIG. 1 is a perspective illustration of the infant cradle assembly of the invention shown mounted on a support stand.
Figure 5:
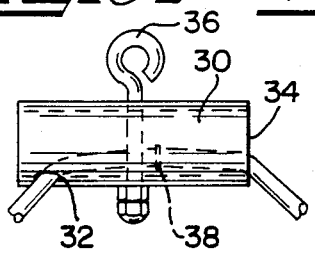
FIG. 5 is a partial schematic side view of the support sleeve of the infant cradle assembly of FIG. 2.
Figure 6:
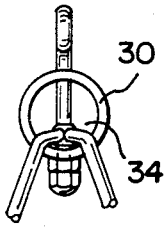
FIG. 6 is a partial end schematic view of the support sleeve of FIG. 5.
Figure 7:
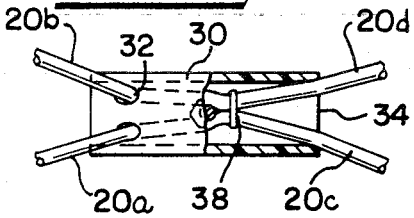
FIG. 7 is a partial top schematic view, with parts in section, of the support sleeve of FIG. 5.
Figure 2:
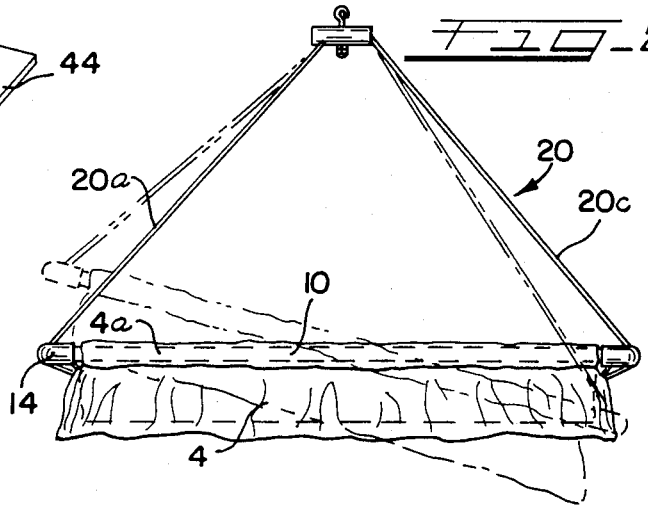
FIG. 2 is a side schematic view of the infant cradle assembly of FIG. 1 with a tilted position shown in phantom.
Figure 3:
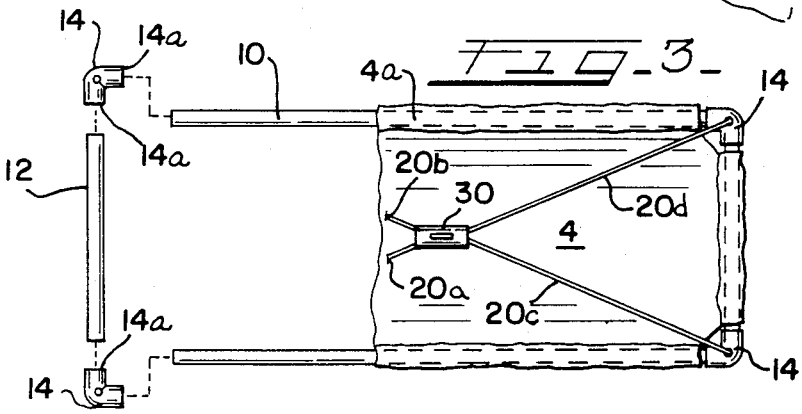
FIG. 3 is a top schematic view, with parts broken away and parts shown in an exploded view, of the infant cradle assembly of FIG. 2.
Figure 8:
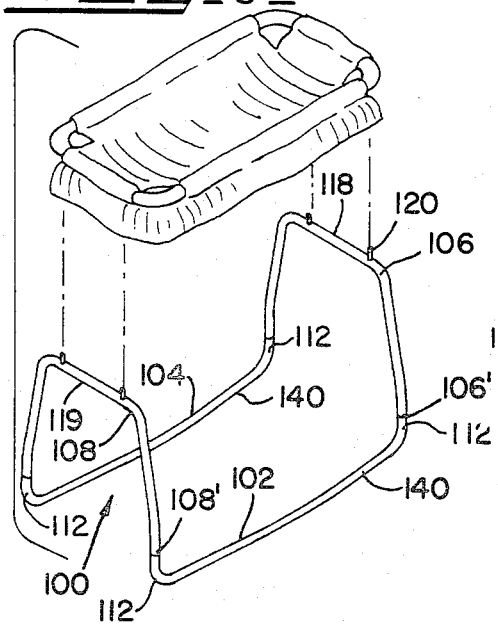
FIG. 8 is a front perspective view, with parts exploded, of a second embodiment of the infant cradle assembly of the invention.
Figure 9:
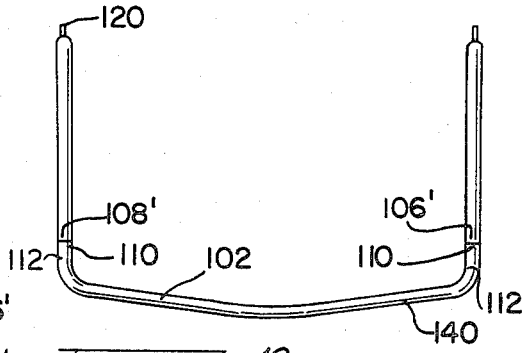
FIG. 9 is a schematic view of the cradle frame of the assembly of FIG. 8.
Figure 10:
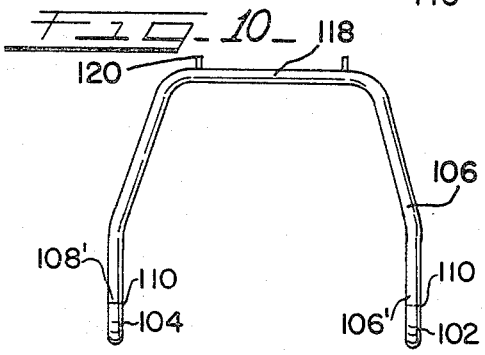
FIG. 10 is an end schematic view of the cradle frame of FIG. 9.

Referring now to FIGS. 1–3, there is illustrated the infant cradle assembly of the invention, generally designated by the reference numeral 1. The cradle assembly comprises a frame assembly 2 around which a suitable sling 4 of cloth or other pliable material is sewn at sleeve 4*a* to hang and form a cradle in which a baby may be carried. Although the sling is disclosed as being cloth, it can be formed from other suitable materials which provide the important characteristics of comfort, security, durability and strength.

Figure 4:
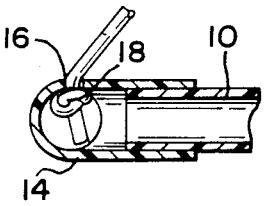
FIG. 4 is a partial sectional view of a corner of the frame assembly of the infant cradle assembly of FIG. 2.

As best shown in FIGS. 2, 3 and 4, frame assembly 2 is formed by a pair of parallel, tubular side members 10 and a pair of end tubular members 12. The ends of side members 10 and end members 12 are interconnected by means of plastic elbows 14 situtated at each corner to construct the frame in a generally rectangular configuration, although other shapes are feasible. The diameter of the ends of the tubular members 10, 12 are selected to create a forced fit or frictional engagement within the openings 14*a* of elbows 14 and suitable retention of the sides and ends of the frame assembly with the capability of being disassembled. Although the frame components may be formed from other material, it has been found that a lightweight, plastic tubing is a particularly desirable material inasmuch as it creates a lightweight frame with less hazard to the infant.

As best shown in FIG. 4, each of the elbows are provided with a hole 16, beneath which a knotted portion 18 of the respective ends of a pair of elongated elastic support cords 20 are situated in a manner that the cradle assembly 1 may be resiliently suspended by the cords. A mid-portion of cords 20 extends through a sleeve or tubular fixture 30 which is adapted to be connected to any suitable support stand, bed, rocker, and the like. The sleeve 30 may be formed from a plastic, metal or similar material. The sleeve 30 is provided with a pair of holes 32 through its surface and at least one open end 34. The pair of cords 20 are directed through the open end 34 and a respective hole 32, such that elastic cord segments 20*a, b, c* and *d* extend between the sleeve 30 and a respective corner of the frame means.

The sleeve 30 is further provided with an eyebolt 36 having an upper end, which allows sleeve means 32*b* to be suspended in a manner shown, and a ring 38 through which cords 20 pass to prevent slippage. The sleeve 30 is capable of being moved relative to the cord 20 in a manner that the length of segments 20*a*, 20*b* may be adjusted relative to the segments 20*c*, 20*d* to alter the orientation of the frame assembly with respect to the horizontal. The sleeve 30 may also function as means to support an object above the infant or be used to act as a handle to carry the cradle from place to place. The resiliency offered by the used of elastic cords 14 permits the cradle to be rocked, swung and otherwise moved in a multitude of various motions due to the oscillations which occur during movement of the cradle. This greatly stimulates the infant and provides for its comfort and amusement. The presence of cords passing through an open end and a pair of holes within the sleeve 30, along with ring 38, insures that, in use, frictional engagement of the cords within the sleeve will occur in a manner that an adjusted position can be set and maintained without slippage.

To adjust the position, the sleeve 30 can selectively be moved relative to the pair of cords to adjust the length of the two segments 20*a, b* with respect to opposite end segments 20*c, d*. This enables the cradle to be tilted as shown in phantom in FIG. 2 whereby the infant may visually see and be stimulated by his surroundings. The eyebolt assembly 36 can be hung on a hook or other member to suspend the cradle therebeneath as shown in FIG. 1. In FIG. 1, the cradle is illustrated being hung on a stand 40 which is capable of resiliently carrying assembly 1 by virtue of its flexible, curved support arm 42 mounted on a base 44 which can be situated on a support surface. Alternatively, the cradle herein disclosed may be secured to any other support surface, bed or be suspended by individual segments attached to a rocking element or the like. In addition, the cradle can be carried by hand as desired.

As should be apparent from the foregoing description, the infant cradle assembly of the invention is portable and lightweight, can be hung on a variety of support structures and is capable of being adjusted. The elastic support cord 20 of the invention causes the cradle to undergo a multitude of motions as the cradle is rocked or swung in its hung configuration. Such motions are stimulating to the infant and provide comfort and amusement. It should be also apparent that when the cradle assembly 1 with resilient cords 20 is attached to a stand 40, such as shown in FIG. 1, additional motions will be compounded with the motions created by the elastic suspension. This further enhances the comfort and enjoyment of the infant in the cradle assembly of the invention. It is also found that the frictional engagements of the ends 10 and sides 12 of the tubular frame with the four elbows 14 allow disassembly of the frame to permit ready removal of the sling 4 for washing or for replacement after extended use.

Refering now to FIGS. 8–11, there is illstrated a second embodiment of the infant cradle assembly of the invention. The cradle assembly 1*a* is generally identical to the cradle assembly described with reference to the embodiment described with reference to FIGS. 1–4, except that the supporting structure is modified. In place of the cords and stand of the preceding figures, the cradle assembly 1*a* is removably affixed to the top of a rocking frame 100.

Figure 11:
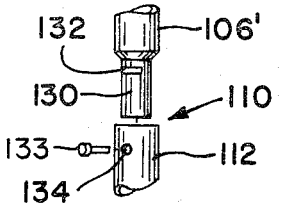
FIG. 11 is an exploded partial view of the swadge connection of the leg of the frame of FIG. 9.

The rocking frame 100 is fabricated from tubular members comprising a pair of base members 102 and 104 and separable side frame members 106 and 108. Each of the side members has a generally modified U-shaped configuration by which the free ends 106' and 108' pivotally interconnect with a swadge connection 110 which couples the side frames to upright end sections 112 of the base members 102 and 104 (FIG. 11). The upper horizontal sections 118 and 119 of the side members include a pair of pins 120 projecting upward to be inserted into holes (not shown) provided in the cradle assembly 1*a*, generally at the corner joints. Thus, the cradle assembly may be removed or attached to the rocker frame as desired.

As best shown in FIG. 11, the swadge connection 110 is formed by a neck down section 130 from the lower ends 106' and 108' of the base tubular members 106 and 108 which mate in telescopic relationship with the larger upper free ends of end sections 112. A horizontal slot 132 is formed in the neck down portion 130 for attachment of the sides 106, 108 to the base members 102, 104 by a clip or pin 133 extending through hole 134 and slot 132. The two side portions of the frame may easily be pivoted relative to the two base sections to fold the side portions against base sections to flatten the frame for easy transport and storage. The bottom shape 140 (FIG. 9) of the central sections of the base members 102 and 104 are bowed somewhat upward to give a rocking action to the cradle assembly mounted thereon.

Figure 12:
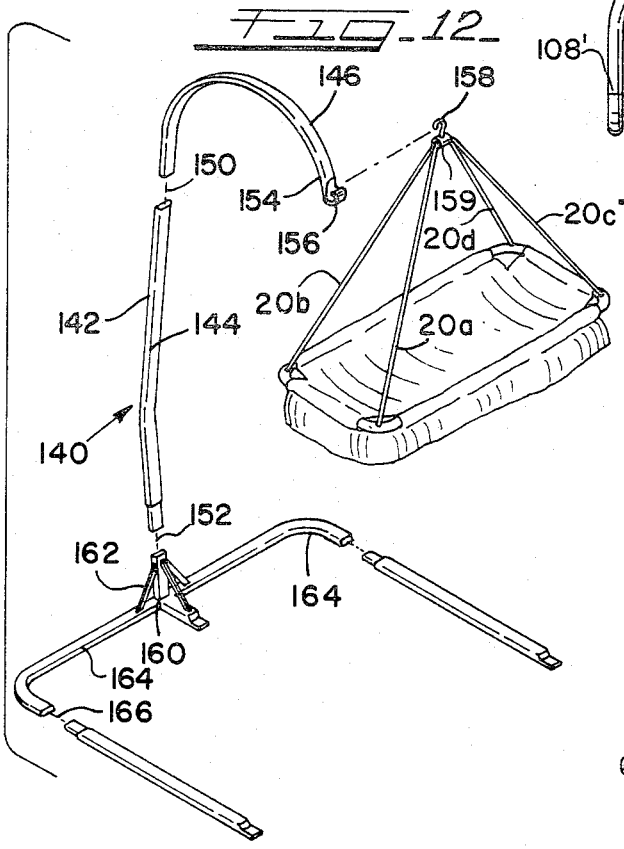
FIG. 12 is a perspective exploded view of still another embodiment of the cradle assembly of the invention.
Figure 13:
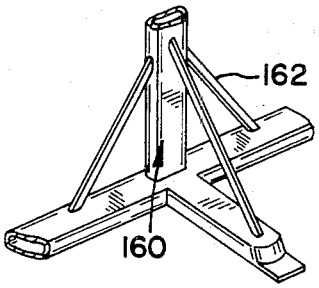
FIG. 13 is a perspective partial view of the base shown in FIG. 12.

Referring to FIGS. 12 and 13, there is illustrated another embodiment of the invention. The embodiment of FIGS. 12 and 13 is generally similar to the embodiment of FIGS. 1–4, except that the stand 140 is made separable in sections to permit transport. The upright tubular member 142 includes a vertical section 144 and an upper curved top 146 portion which is separable through a telescopic connection at joints 150, 152 formed by neck down portions of one of the telescoping parts. The free end portion 154 of the curved upper section 146 is formed with a hook 156 which mates with an oppositely, but corresponding hook 159 provided on the sleeve 156, upon which the cords **20*b* of the cradle assembly are suspended. Thus, the cradle can easily be coupled and removed from the stand. The base 160 frame is reinforced by a series of support members 162 and the right angle legs 164 are separable at joints 166** to permit assembly and disassembly of the stand for transport and portability.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An infant cradle assembly comprising a frame assembly having a plurality of parts capable of being disassembled;

bed means attached to said frame assembly and arranged to hang therefrom to form a bed;

a plurality of support cords being coupled to a plurality of points on said frame assembly and being arranged to be attached to a carrier;

said support cords being formed from a resilient material for inducing a multitude of motions on said frame means and said bed means while attached to a carrier;

said plurality of support cords comprise a pair of support cords having their opposite ends attached to opposed points on said frame means; and a support sleeve through which an intermediate section of said support cords extend, said support sleeve further including means for attaching said sleeve to a carrier to support said frame assembly and said bed means.

2. The cradle assembly according to claim 1 wherein said bed means is a fabric sling hanging from said frame assembly.

3. The cradle assembly according to claim 1 wherein said frame assembly includes a plurality of interconnected tubular members.

4. The cradle assembly according to claim 3 wherein said tubular members are interconnected by four elbows to form a rectangular frame.

5. The cradle assembly according to claim 4 wherein said plurality of parts to which said support cords are coupled are respectively located on each of said elbows.

6. The cradle assembly according to claim 1 wherein said sleeve includes a body having hollow ends and a pair of lateral openings, said pair of cords being arranged to pass through said open ends and a respective one of said holes.

7. The cradle assembly according to claim 6 wherein said sleeve may be selectively moved relative to said support cord to permit the frame assembly and bed means to be tilted relative to a horizontal plane.

8. An infant cradle assembly comprising frame means including a plurality of interconnected tubular members;

a sling hanging from said tubular frame members;

a rocker frame having a pair of tubular base members capable of inducing a rocking action and a pair of tubular end sections removably attached to said base members at opposite ends thereof;

said frame means being removably affixed to said end sections; and a swage connection removably attaching said pair of base members to said end sections, said swage connection having means for coupling said pair of base members and end sections together and permitting free relative rotational movement between said base members and said end sections to allow said rocker frame to be folded in a generally flat configuration.

9. The cradle assembly according to claim 8 wherein said end sections have a modified U-shape, the free ends of said U-shape sections interconnecting with upright free end portions formed on said base members in telescopic relationship.

10. The cradle assembly according to claim 9 further including means to retain said free ends and free end portions together, said means to retain further including a slot formed in either of said free ends or said free end portions, said means to retain further including a clip extending through said free ends and said free end portions in position in said slot.

* * * * *